US011519421B2

(12) United States Patent
Lin et al.

(10) Patent No.: US 11,519,421 B2
(45) Date of Patent: Dec. 6, 2022

(54) WIND WHEEL AND BLOWER COMPRISING THE SAME

(71) Applicant: Zhongshan Broad-Ocean Motor Co., Ltd., Zhongshan (CN)

(72) Inventors: Yanhu Lin, Zhongshan (CN); Miao Zhang, Zhongshan (CN); Yong Lin, Zhongshan (CN); Baixian Xiao, Zhongshan (CN)

(73) Assignee: ZHONGSHAN BROAD-OCEAN MOTOR CO., LTD., Zhongshan (CN)

( * ) Notice: Subject to any disclaimer, the term of this patent is extended or adjusted under 35 U.S.C. 154(b) by 351 days.

(21) Appl. No.: 16/503,608

(22) Filed: Jul. 4, 2019

(65) Prior Publication Data

US 2020/0011343 A1 Jan. 9, 2020

(30) Foreign Application Priority Data

| | | |
|---|---|---|
| Jul. 6, 2018 | (CN) | 201821066118.4 |
| Jul. 6, 2018 | (CN) | 201821066119.9 |
| Jul. 6, 2018 | (CN) | 201821066120.1 |
| Jul. 6, 2018 | (CN) | 201821066376.2 |
| Aug. 7, 2018 | (CN) | 201821259173.5 |

(51) Int. Cl.

| | |
|---|---|
| ***F04D 29/28*** | (2006.01) |
| ***F04D 17/02*** | (2006.01) |
| ***F04D 29/30*** | (2006.01) |

(52) U.S. Cl.

CPC ..... *F04D 29/281* (2013.01); *F04D 17/025* (2013.01); *F04D 29/30* (2013.01)

(58) Field of Classification Search

CPC ..... F04D 29/281; F04D 29/30; F04D 17/025; F04D 25/08

See application file for complete search history.

(56) References Cited

U.S. PATENT DOCUMENTS

| | | | | |
|---|---|---|---|---|
| 6,042,335 | A * | 3/2000 | Amr | F04D 29/282 415/173.1 |
| 6,164,919 | A * | 12/2000 | Vanmoor | B64C 11/16 416/243 |
| 6,261,051 | B1 * | 7/2001 | Kolacny | F03B 3/00 415/53.3 |
| 6,340,291 | B1 * | 1/2002 | Reckert | F04D 29/284 416/185 |
| 6,558,120 | B2 * | 5/2003 | Kim | F04D 25/12 416/186 R |
| 6,679,682 | B2 * | 1/2004 | Lee | F04D 29/023 415/206 |
| 6,848,887 | B2 * | 2/2005 | Kim | F04D 29/281 416/186 R |

(Continued)

*Primary Examiner* — Courtney D Heinle
*Assistant Examiner* — Andrew Thanh Bui
(74) *Attorney, Agent, or Firm* — Matthias Scholl P.C.; Matthias Scholl

(57) ABSTRACT

A wind wheel including a first air plate, a second air plate, and a plurality of blades disposed between the first air plate and the second air plate. The first air plate includes a central part and an air inlet disposed in the central part; each two adjacent blades form an air duct. The plurality of blades each includes an inlet section next to the air inlet, an intermediate section, and an outlet section. The thickness of the intermediate section is greater than the thickness of the inlet section and the thickness of the outlet section.

17 Claims, 23 Drawing Sheets

(56) References Cited

U.S. PATENT DOCUMENTS

| | | | | |
|---|---|---|---|---|
| 7,191,613 | B2 * | 3/2007 | Lee | F04D 17/165 62/262 |
| 7,422,418 | B2 * | 9/2008 | Ishijima | F04D 29/283 415/119 |
| 9,039,362 | B2 * | 5/2015 | Fukuda | F04D 25/0613 415/206 |
| 2019/0128280 | A1 * | 5/2019 | Horii | F04D 29/281 |
| 2019/0374732 | A1 * | 12/2019 | Cariola | F04D 29/30 |
| 2020/0011343 | A1 * | 1/2020 | Lin | F04D 17/025 |
| 2020/0263699 | A1 * | 8/2020 | Li | F04D 29/023 |
| 2020/0309148 | A1 * | 10/2020 | Lin | F04D 29/30 |

* cited by examiner

WIND WHEEL AND BLOWER COMPRISING THE SAME

CROSS-REFERENCE TO RELATED APPLICATIONS

Pursuant to 35 U.S.C. § 119 and the Paris Convention Treaty, this application claims foreign priority to Chinese Patent Application No. 201821066119.9 filed Jul. 6, 2018, to Chinese Patent Application No. 201821066118.4 filed Jul. 6, 2018, to Chinese Patent Application No. 201821066120.1 filed Jul. 6, 2018, to Chinese Patent Application No. 201821066376.2 filed Jul. 6, 2018, and to Chinese Patent Application No. 201821259173.5 filed Aug. 7, 2018. The contents of all of the aforementioned applications, including any intervening amendments thereto, are incorporated herein by reference. Inquiries from the public to applicants or assignees concerning this document or the related applications should be directed to: Matthias Scholl PC., Attn.: Dr. Matthias Scholl Esq., 245 First Street, 18th Floor, Cambridge, Mass. 02142.

BACKGROUND

The disclosure relates to a wind wheel and a blower comprising the same.

As shown in FIGS. 1-2, a conventional wind wheel includes a first air plate 1*a*, a second air plate 2*a*, and a plurality of blades 3*a* disposed between the first air plate 1*a* and the second air plate 2*a*. The air inlet 11*a* is disposed in the middle of the first air plate 1*a*. The plurality of blades 3*a* each include an inlet end 30*a* disposed near the air inlet, and an air duct 31*a* is formed between two adjacent blades 3*a*. Each of the blades 3*a* includes an inner flank 32*a* and an outer flank 33*a*. The outer diameter Da of every circle formed by the outer flank 33*a* of the blade 3*a* is constant, and the outer flank 33*a* of the blade 3*a* is perpendicular to the first air plate 1*a* and the second air plate 2*a*.

The above structure has the following defects. The thickness of the blade 3*a* from the inlet 3*a*1 to the outlet 3*a*2 of the air duct is constant, thus consuming a large amount of materials and causing relatively high production cost. In addition, the airflow has a strong impact on the inlet of the wind blade, which may cause loud noise and strong vibration of the whole machine.

SUMMARY

The disclosure provides a wind wheel and a blower comprising the same. The manufacturing of the wind wheel consumes a relatively small amount of materials, and the blower comprising the wind wheel runs with less noise and vibration compared with conventional blowers.

Disclosed is a wind wheel comprising a first air plate, a second air plate, and a plurality of blades disposed between the first air plate and the second air plate. The first air plate comprises a central part and an air inlet disposed in the central part; each two adjacent blades form an air duct; the plurality of blades each comprises an inlet section next to the air inlet, an intermediate section, and an outlet section; and the thickness of the intermediate section is greater than the thickness of the inlet section and the thickness of the outlet section.

The intermediate section comprises a middle part and two ends; and the thickness of the intermediate section decreases from the middle part to the two ends.

The inlet section comprises a first connecting end connected to the intermediate section and an innermost end next to the air inlet; and the thickness of the inlet section decreases from the first connecting end to the innermost end.

The outlet section comprises a second connecting end connected to the intermediate section and an outermost end connected to the second connecting end; and the thickness of the outlet section decreases from the second connecting end to the outermost end.

The profile of each of the plurality of blades is an arc; randomly select a point on the arc, the point defines a circle which is concentric to the air inlet; an included angle formed by a first tangent L1 of the point on the circle and a second tangent L2 of the point on the arc is defined as an inlet angle, and the inlet angle increases from the innermost end to the outermost end.

The innermost end has the inlet angle of θ1, the outermost end has the inlet angle of θ2, and θ2=1.5 θ1; the thickness of the innermost end is H1, the thickness of the outermost end is H3, the thickness of the middle part is H2, and H1=H3=0.5 H2.

The inlet section extends in the air inlet; a diameter D1 of the air inlet is greater than or equal to a diameter D2 of the second air plate; an outer diameter D3 of the plurality of blades is less than or equal to an outer diameter D4 of the first air plate; and the outlet section of each of the plurality of blades protrudes radially out of an edge of the second air plate.

The outlet section comprises a boss; the boss protrudes axially out of a surface of the second air plate; and the first air plate, the second air plate, the plurality of blades and the boss form an integrated structure through injection molding.

A portion of the inlet section axially extends out of a surface of the first air plate.

The inlet section comprises an inlet end; a flank of the inlet end is tilted; and the flank of the inlet end is not perpendicular to the first air plate.

The distance from a top end of the plurality of blades to a bottom surface of the second air plate is inconstant and decreases from a center to an edge of the second air plate.

The height of the second air plate decreases from the center to the edge of the second air plate; and a height of the air duct increases from the center to the edge of the second air plate.

The cross section of the first air plate is an arc structure.

Each of the plurality of blades comprises an inner flank and an outer flank relative to the air inlet; the outer flank is inclined inwards relative to the air inlet; the outer flank comprises an upper end and a lower end relative to the first air plate; an outer diameter D5 of a circle formed by the lower end of the outer flank is larger than an outer diameter D6 of a circle formed by the upper end of the outer flank; and an outer diameter of a circle formed by the outer flank decreases from the lower end to the upper end.

The ratio of the outer diameter D6 of the circle formed by the upper end of the outer flank to the outer diameter D5 of the circle formed by the lower end of the outer flank is between 0.95 and 0.97.

The plurality of blades each comprises a first side and a second side; the first side is a pressure side, and the second side and the outer flank are negative pressure sides; and an intersection line of the outer flank and the first side is an inclined line, which is inclined inwards relative to the air inlet.

The plurality of blades each comprises an inner end section which comprises a tip axially extending out of the first air plate.

The inner flank is an inclined plane extending from the tip to the second air plate; the tip extends to an inner edge of the first air plate to form a bottom surface which is an inclined plane; and a slope of the inner flank is larger than that of the bottom surface.

A blower comprises a volute comprising an air outlet, a cover plate comprising an air inlet, a motor, a motor shaft, the aforesaid wind wheel, and a cavity formed by the volute and the cover plate; the wind wheel is disposed in the cavity.

Compared with the prior art, the wind wheel of the disclosure has the following advantages:

1) The material consumption and material cost of the blades are both reduced.

2) The thickness of the inlet section is inconstant; thickness of the inlet section decreases from the first connecting end to the innermost end; this design can reduce the impact of airflow on the inlet of blades and reduce the noise and vibration of the whole machine.

3) The thickness of the outlet section is inconstant; the thickness of the outlet section decreases from the second connecting end to the outermost end; this design increases the exit area of the wind wheel, which can reduce the vibration and noise of the whole machine.

4) The profile of the blade consists of a multi-section arc. The inlet angle increases from the innermost end to the outermost end. Thus, the operation efficiency of the wind turbine is improved, and the exhaust volume of the whole machine is increased.

5) The inlet section is exposed at the air inlet, the diameter of the air inlet is greater than or equal to the diameter of the second air plate, the outer diameter of the blade is less than or equal to the outer diameter of the first air plate, the outlet section of the blade protrudes radially out of the edge of the second air plate; this design reduces the material consumption and cost of the wind wheel, increases the exit area of the wind wheel, and reduce the vibration and noise of the whole machine.

6) The boss protrudes axially out of the bottom surface of the second air plate, which can increase the negative pressure value and reduce noise; the first air plate, the second air plate, the blades and the boss are integrally injection molded, the manufacturing process is simple, and the overall stability of the wind wheel is good.

7) A portion of the inlet section axially extends out of the top surface of the first air plate; when the wind wheel is running, the airflow is sucked into the wind wheel by the protruding blade portion to improve the operation effect of the wind wheel.

8) The side of the inlet section is an inclined line, that is, the inlet section is not perpendicular to the first air plate.; this design reduces the impact of airflow on the wind wheel and reduce the noise and vibration of the whole machine.

9) The cross section of the first air plate is an arc structure, thus improving the structural strength.

10) The ratio of the outer diameter of the circle formed by the upper end of the outer flank to the outer diameter of the circle formed by the lower end of the outer flank is between 0.95 and 0.97; the impact of the airflow on the housing and the tongue of the housing is weakened and evenly dispersed, which significantly reduces the noise and vibration of the induced draft fan.

DETAILED DESCRIPTION

To further illustrate, examples detailing a wind wheel are described below. It should be noted that the following examples are intended to describe and not to limit the description.

EXAMPLE 1

Figure 1:
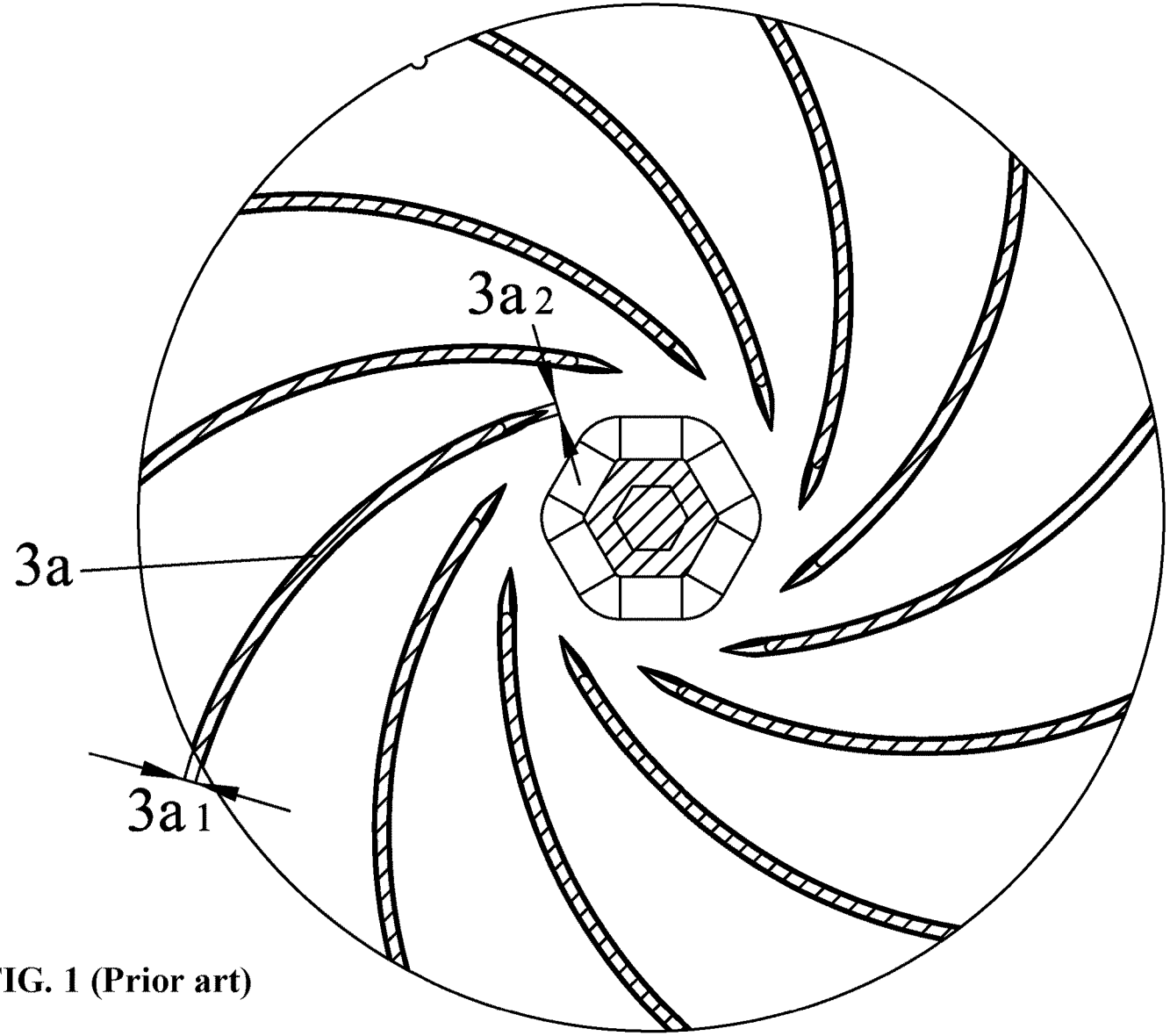
FIG. 1 (Prior art)
FIG. 1 is a front view of a wind wheel in the related art.
Figure 2:
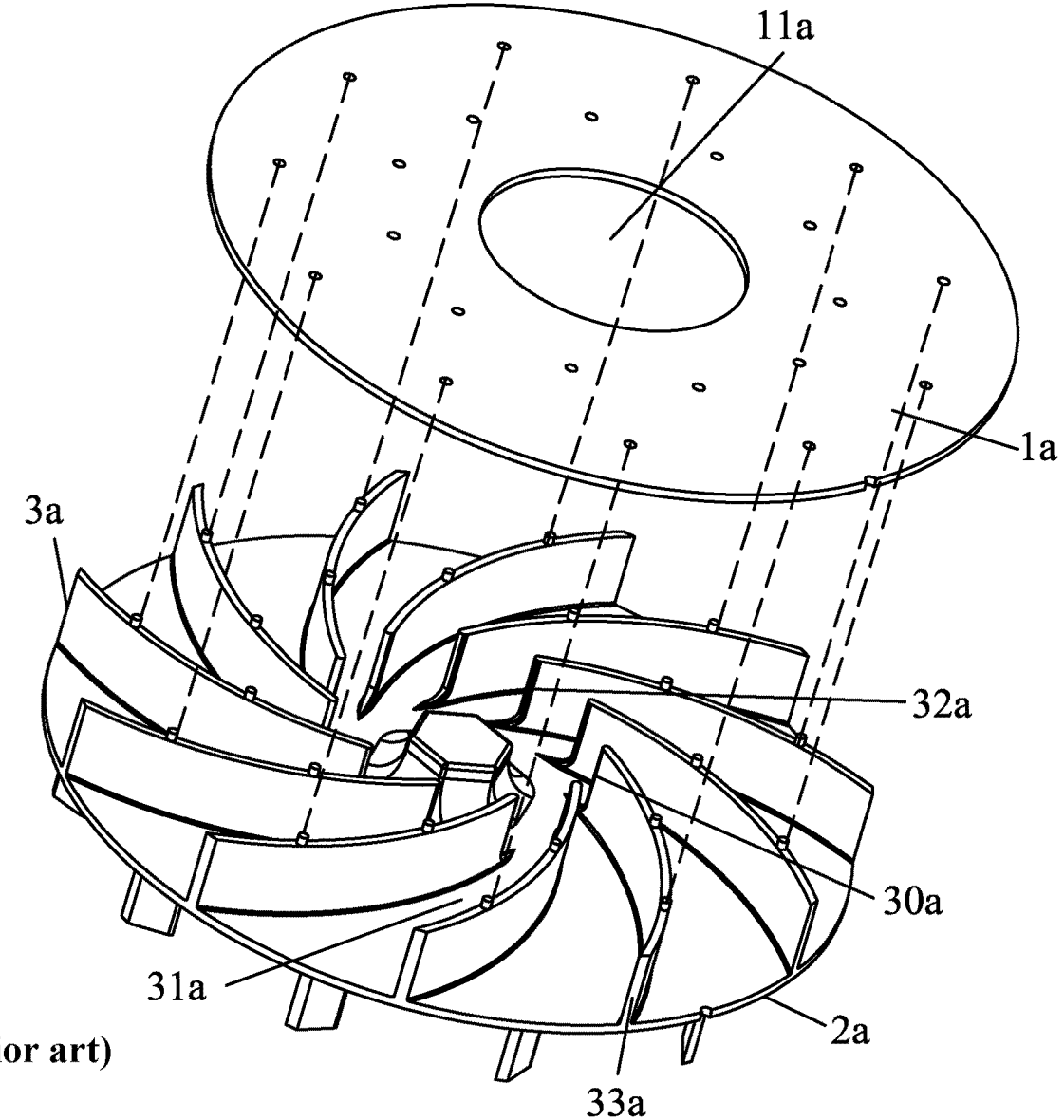
FIG. 2 (Prior art)
FIG. 2 is a perspective view of a wind wheel in the related art.
Figure 3:
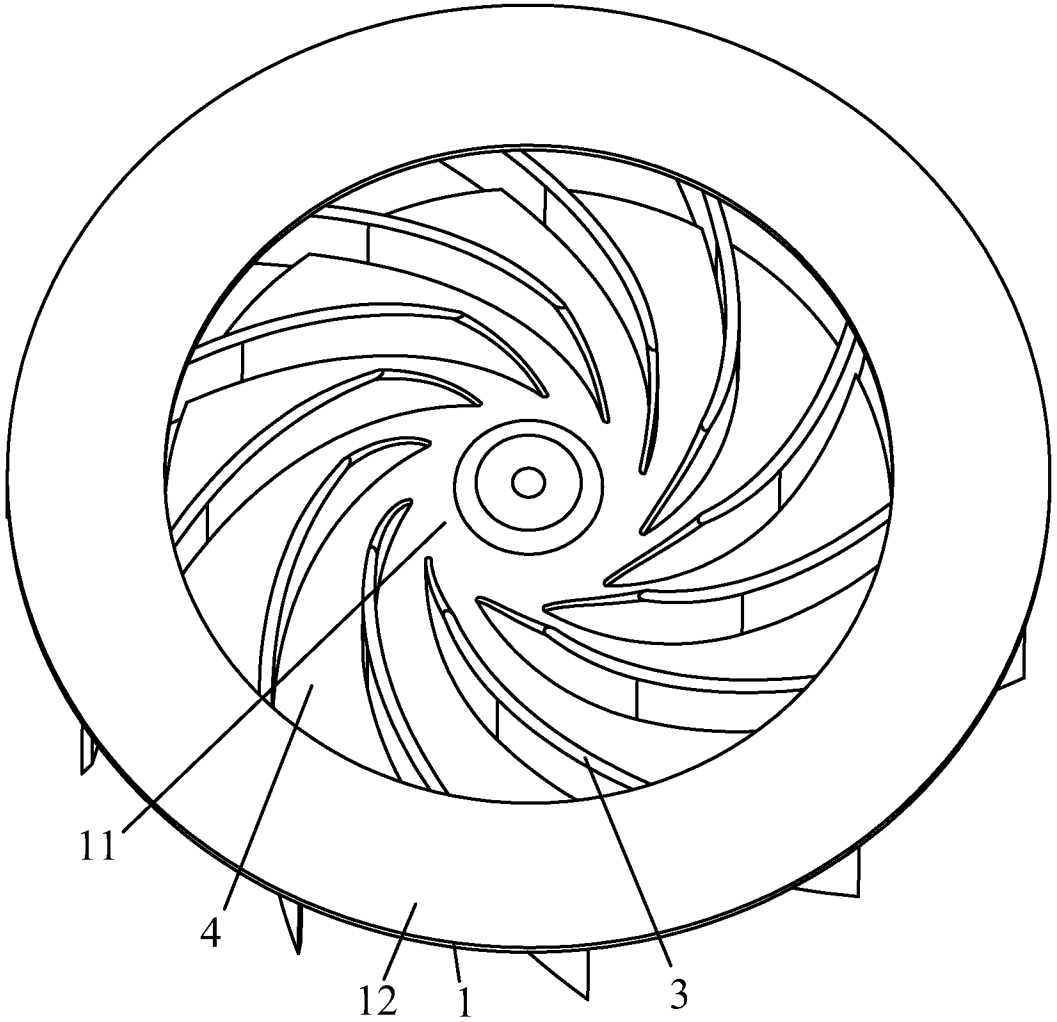
FIG. 3 is a perspective view of a wind wheel in Example 1 of the disclosure.
Figure 4:
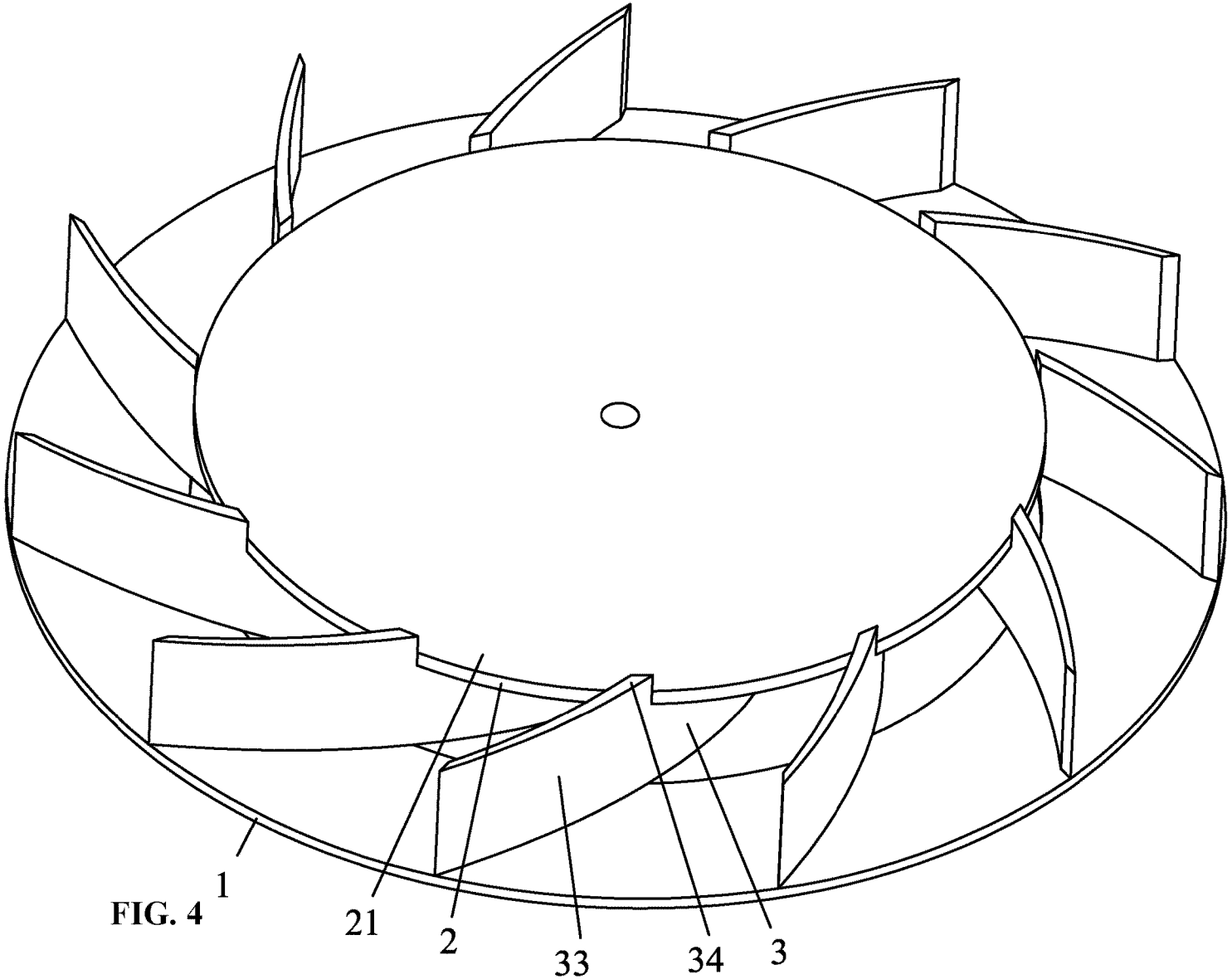
FIG. 4 is a perspective view of a wind wheel in Example 1 of the disclosure at another angle.
Figure 5:
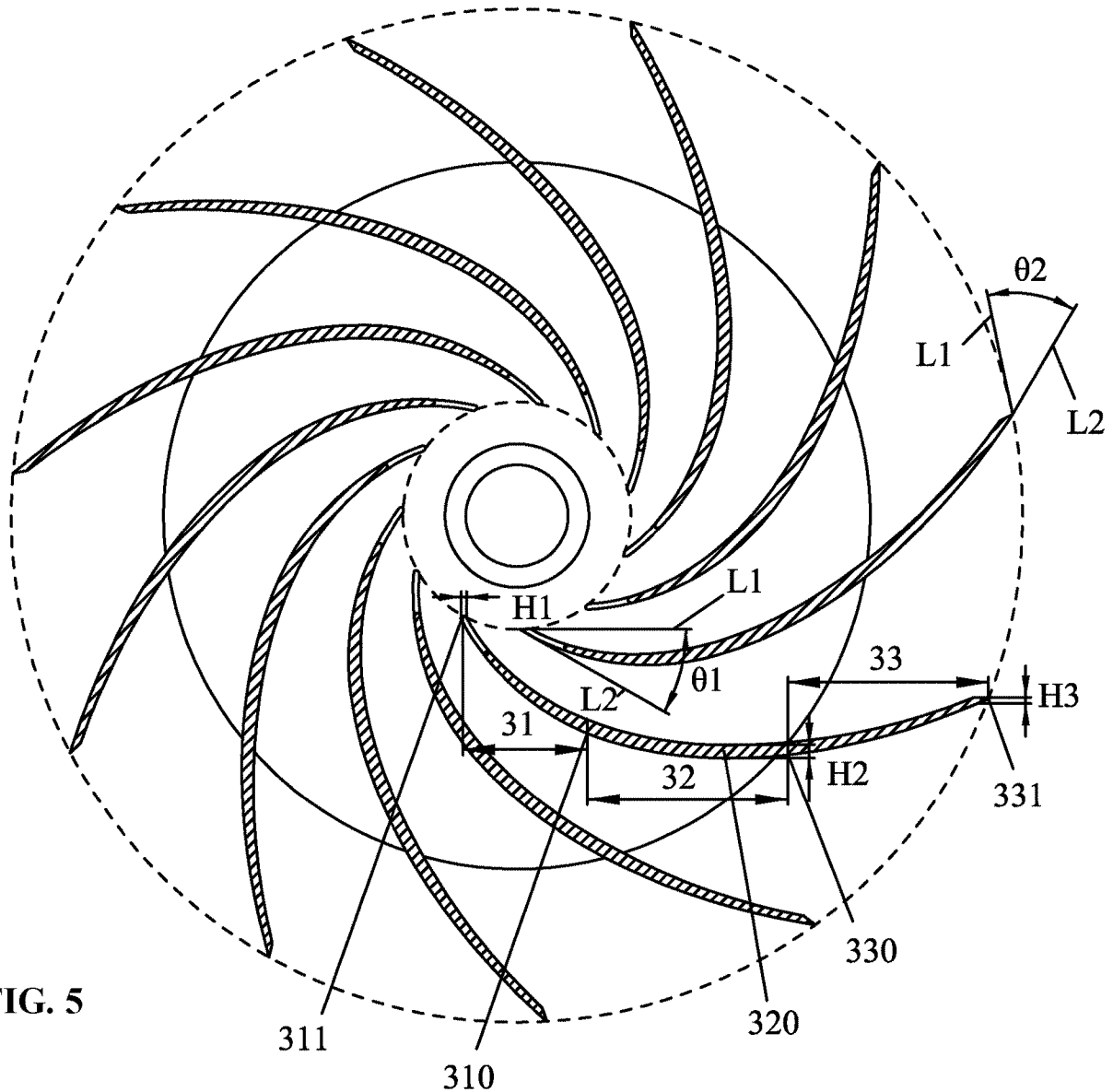
FIG. 5 is a partial structural view of a wind wheel in Example 1 of the disclosure.
Figure 6:
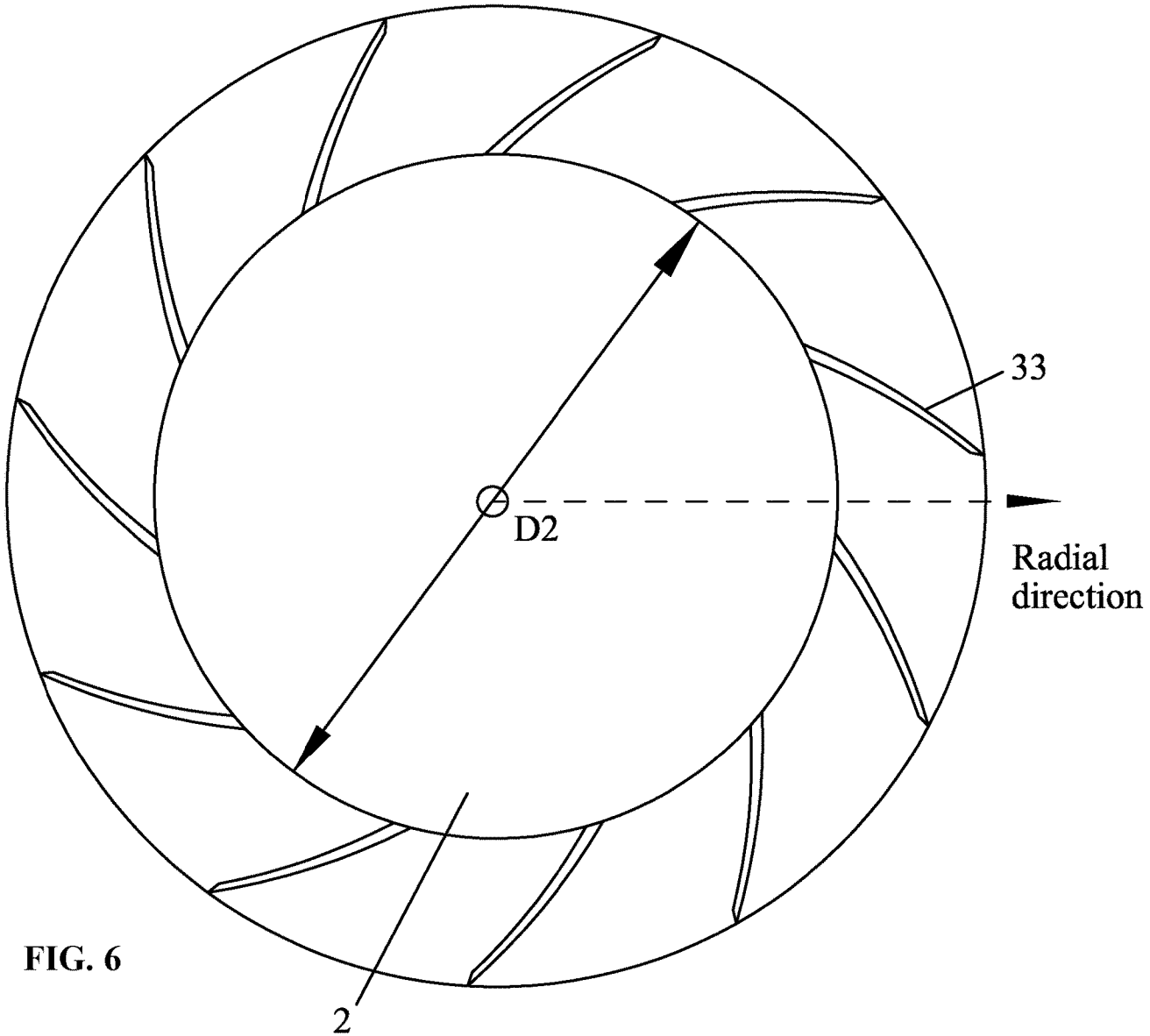
FIG. 6 is a top view of a wind wheel in Example 1 of the disclosure.
Figure 7:
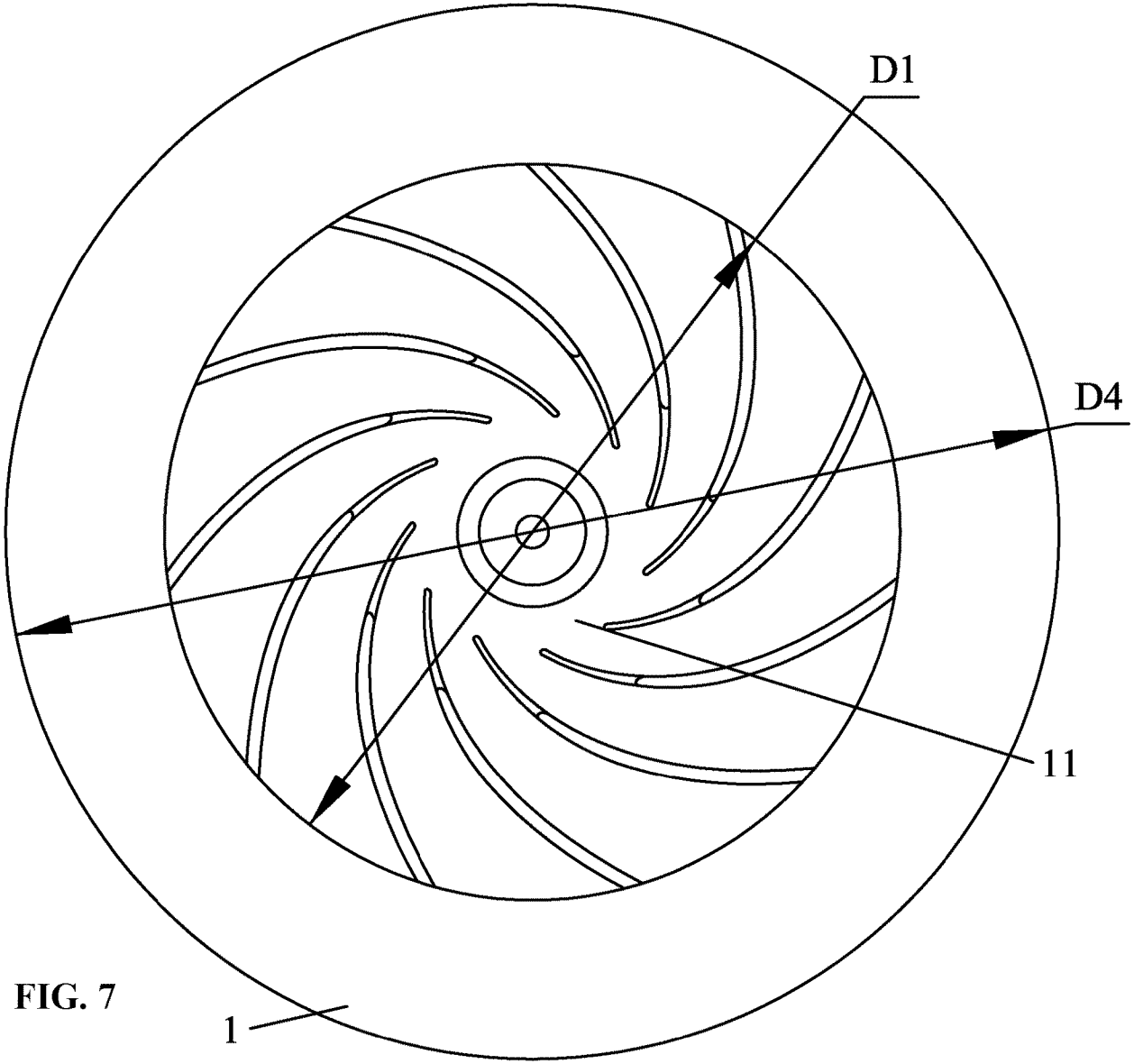
FIG. 7 is a bottom view of a wind wheel in Example 1 of the disclosure.
Figure 8:
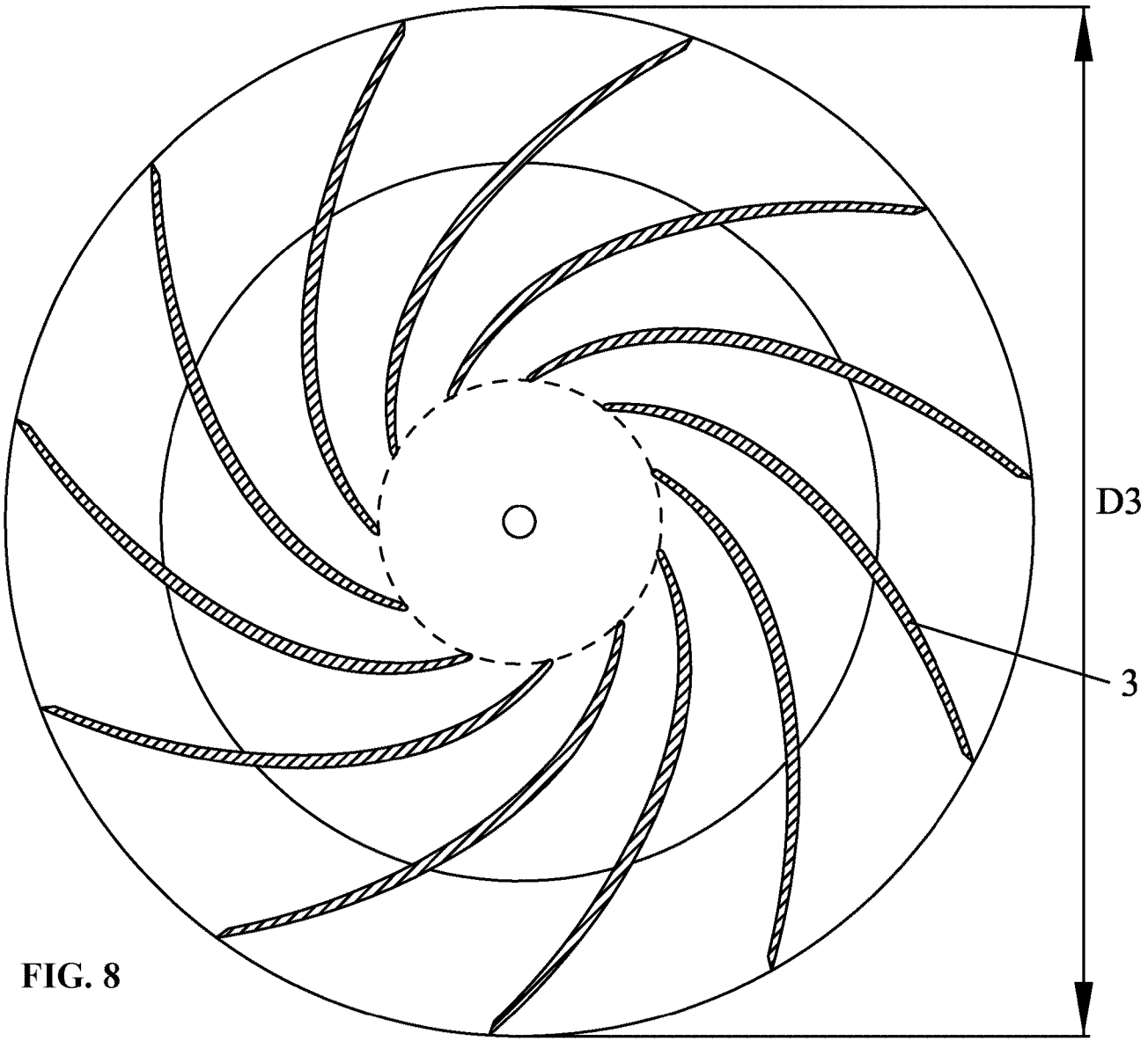
FIG. 8 is a schematic view showing the structure of a wind wheel in Example 1 of the disclosure.
Figure 9:
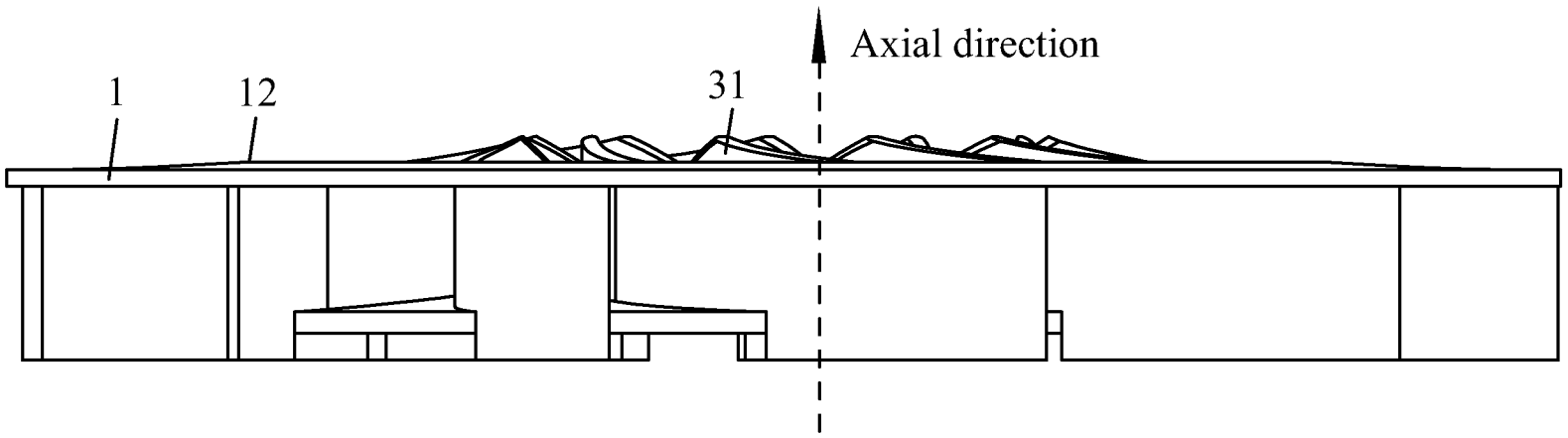
FIG. 9 is a front view of a wind wheel in Example 1 of the disclosure.
Figure 10:
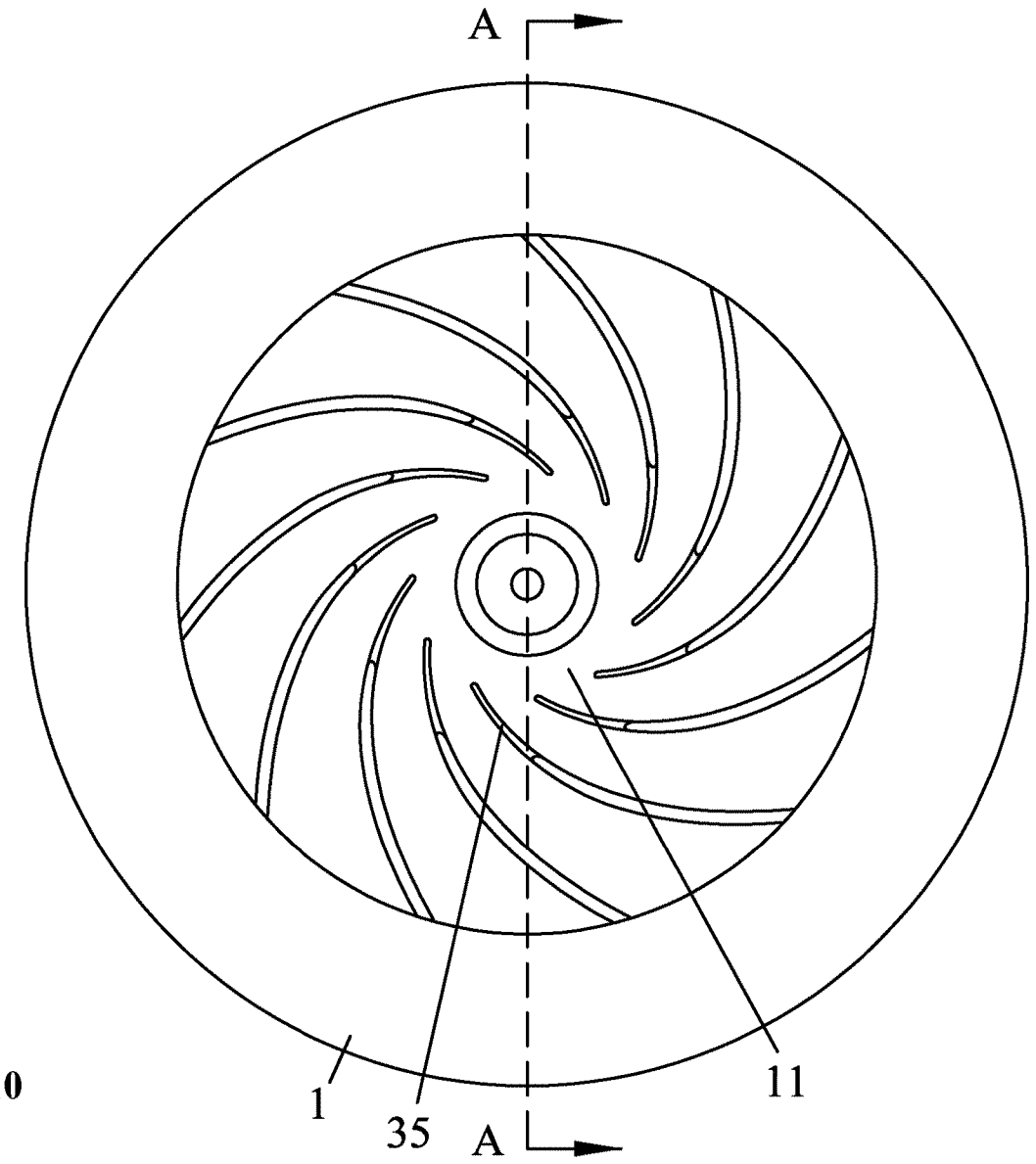
FIG. 10 is a bottom view of a wind wheel in Example 1 and Example 2 of the disclosure.
Figure 11:
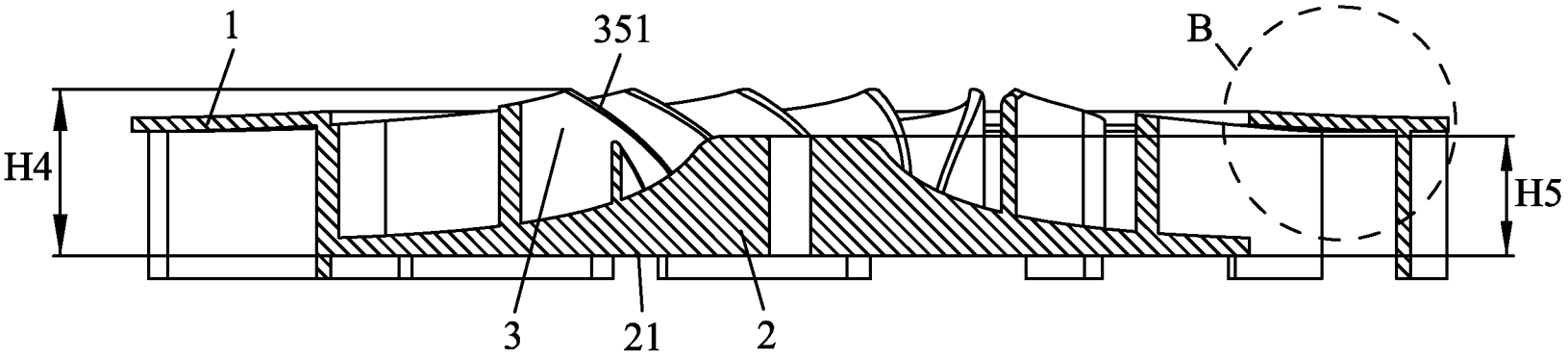
FIG. 11 is a cross-sectional view taken along line A-A of FIG. 10.
Figure 12:
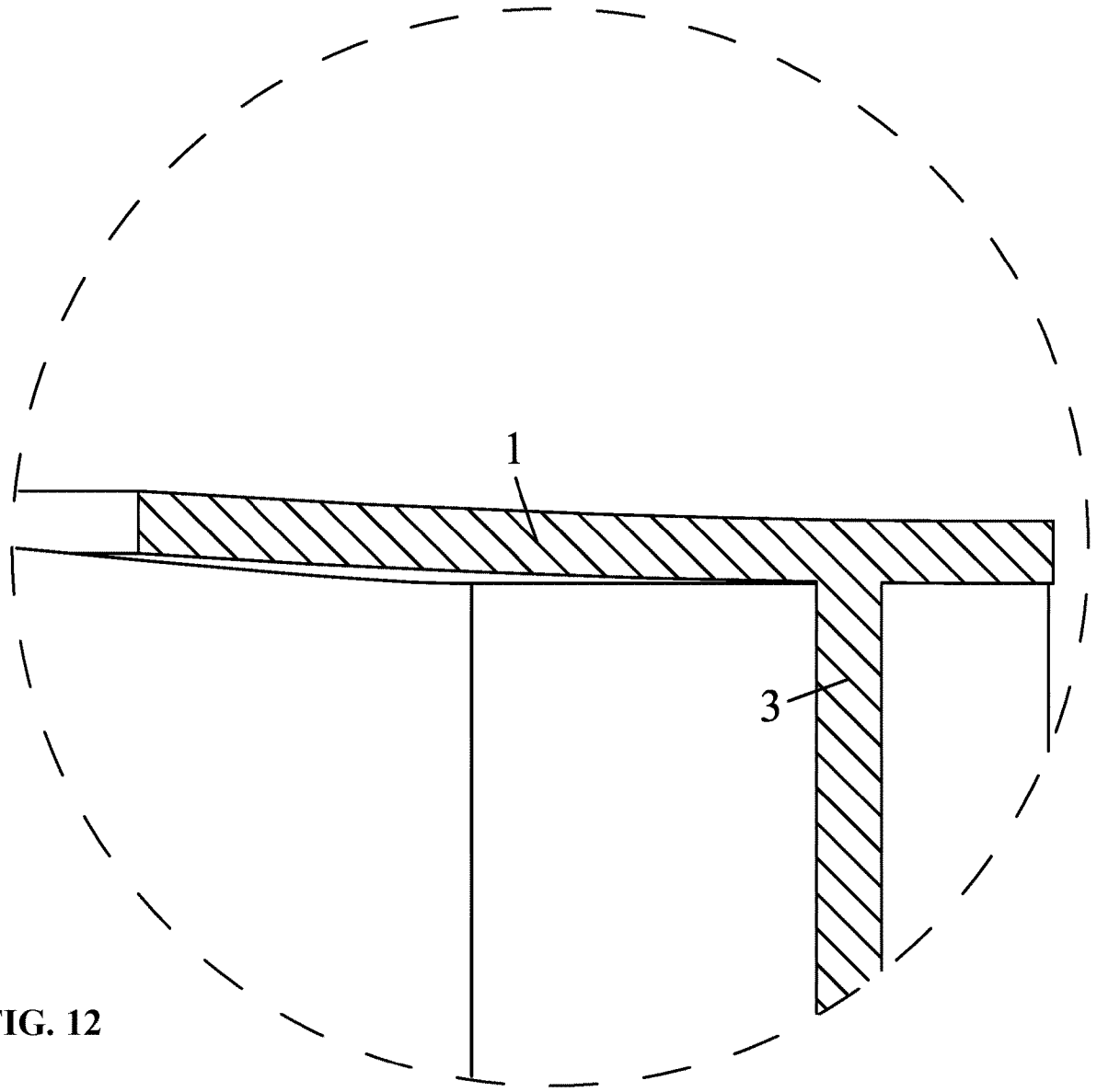
FIG. 12 is a partial enlarged view of B in FIG. 11.

As shown in FIG. 3 to FIG. 12, a wind wheel comprises a first air plate 1, a second air plate 2, and a plurality of blades 3 disposed between the first air plate 1 and the second air plate 2; an air inlet 11 is disposed in the middle of the first air plate 1, and an air duct 4 is formed between the two adjacent blades 3. Each of blades 3 of the wind wheel comprises an inlet section 31, an intermediate section 32 and an outlet section 33, where the thickness of the intermediate section 32 is greater than that of the inlet section 31, and the thickness of the intermediate section 32 is greater than that of the outlet section 33.

The thickness of the intermediate section 32 is inconstant, the thickness H2 at the intermediate portion 320 of the intermediate section 32 being the largest, but gradually decreasing from the middle to the both sides.

The thickness of the inlet section 31 is inconstant, the thickness of the first connecting end 310 connected to the intermediate section 32 is the largest, the thickness from the first connecting end 310 to the innermost end 311 is gradually reduced, and the minimum thickness of the innermost end 311 is H1.

The thickness of the outlet section 33 is inconstant, the thickness of the second connecting end connected 330 to the intermediate section 32 is the largest, the thickness from the second connecting end 330 to the outermost end 331 is gradually reduced, and the minimum thickness of the innermost end 331 is H3.

The profile of the blade 3 consists of a multi-section arc. The inlet angle, which means the angle between the tangent L1 of the circumference and the tangent L2 of the profile of the blade 3 at that point, gradually increases from the innermost end 311 to the outermost end 331.

The inlet section 31 has an inlet angle of θ1, the outlet section 33 has an inlet angle of θ2, the θ2=1.5 θ1, and H1=H3=0.5 H2.

The inlet section 31 is exposed at the air inlet 11, the diameter D1 of the air inlet 11 is greater than or equal to the diameter D2 of the second air plate 2, the outer diameter D3 of the blade 3 is less than or equal to the outer diameter D4 of the first air plate 1, the outlet section 33 of the blade 3 protrudes radially out of the edge of the second air plate 2.

The boss 34 is disposed on the outlet section 33, the boss 34 protrudes axially out of the bottom surface 21 of the second air plate 2; the first air plate 1, the second air plate 2, the blades 3 and the bosses 4 are integrally injection molded.

A portion of the inlet section 31 axially extends away from the top surface 12 of the first air plate 1.

EXAMPLE 2

Figure 13:
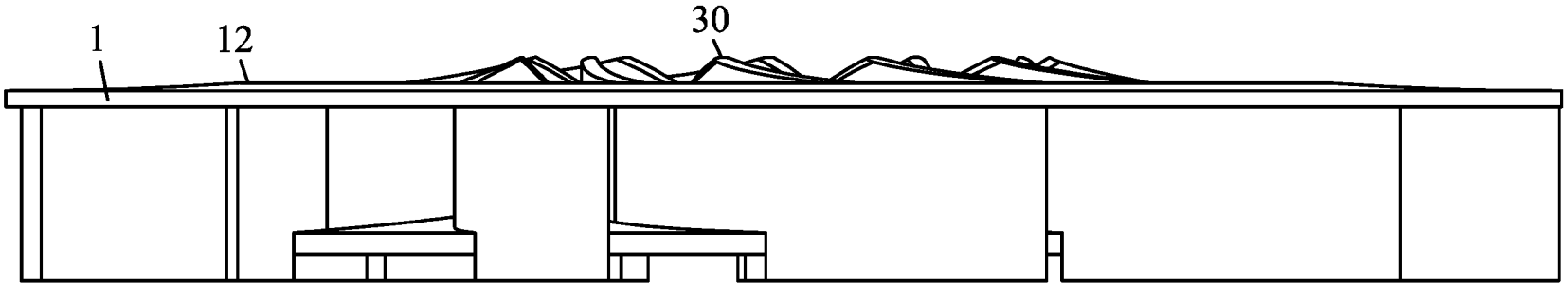
FIG. 13 is a front view of a wind wheel in Example 2 of the disclosure.
Figure 14:
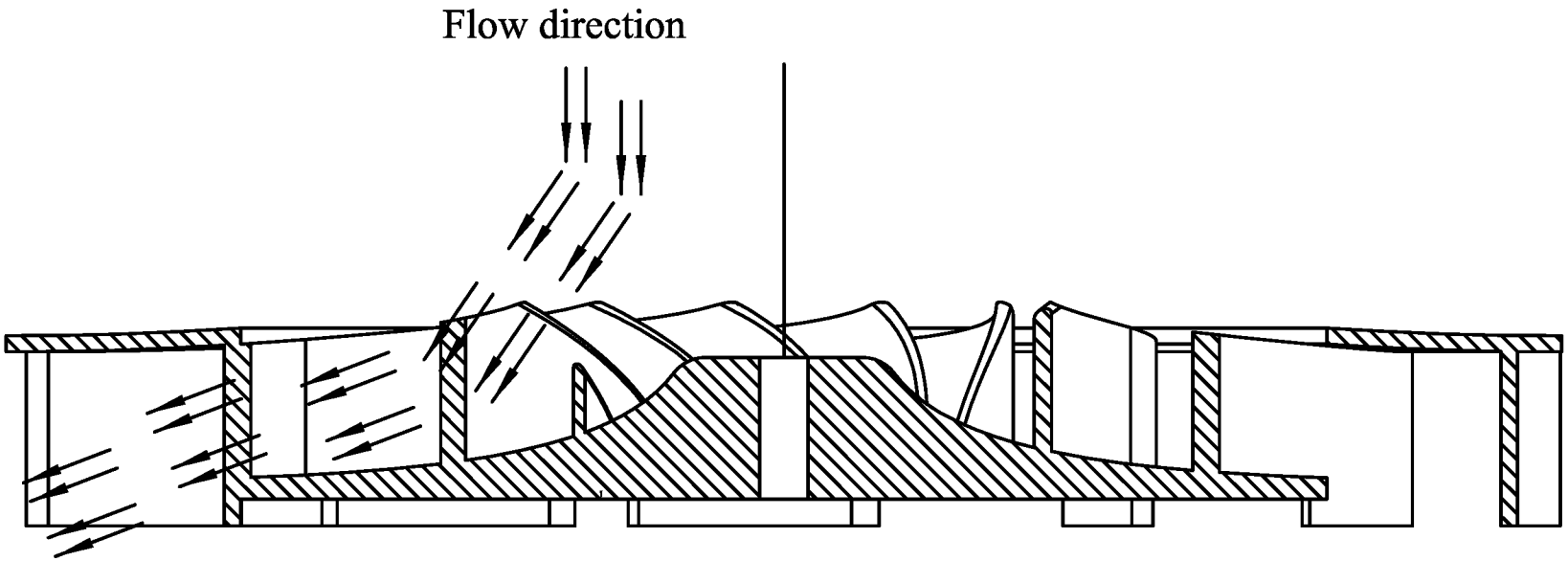
FIG. 14 is a schematic view showing the wind direction of a wind wheel in Example 2 of the disclosure.

As shown in FIG. 10 to FIG. 14, the example is an improvement on the basis of Example 1; the flank 351 of the inlet end 35 is an inclined line, that is, the inlet end 35 is not perpendicular to the first air plate 1.

H4, which is the distance from the top end 30 of the blade to the bottom surface 21 of the second air plate 2, gradually changes from high to low from the center to the edge of the second air plate 2.

H5, which is the height of the second air plate 2, gradually changes from low to high from the center to the edge of the second air plate 2, so that the height of the air duct 31 gradually changes from high to low from the center to the edge of the second air plate 2.

The cross section of the first air plate 1 is an arc structure.

EXAMPLE 3

Figure 15:
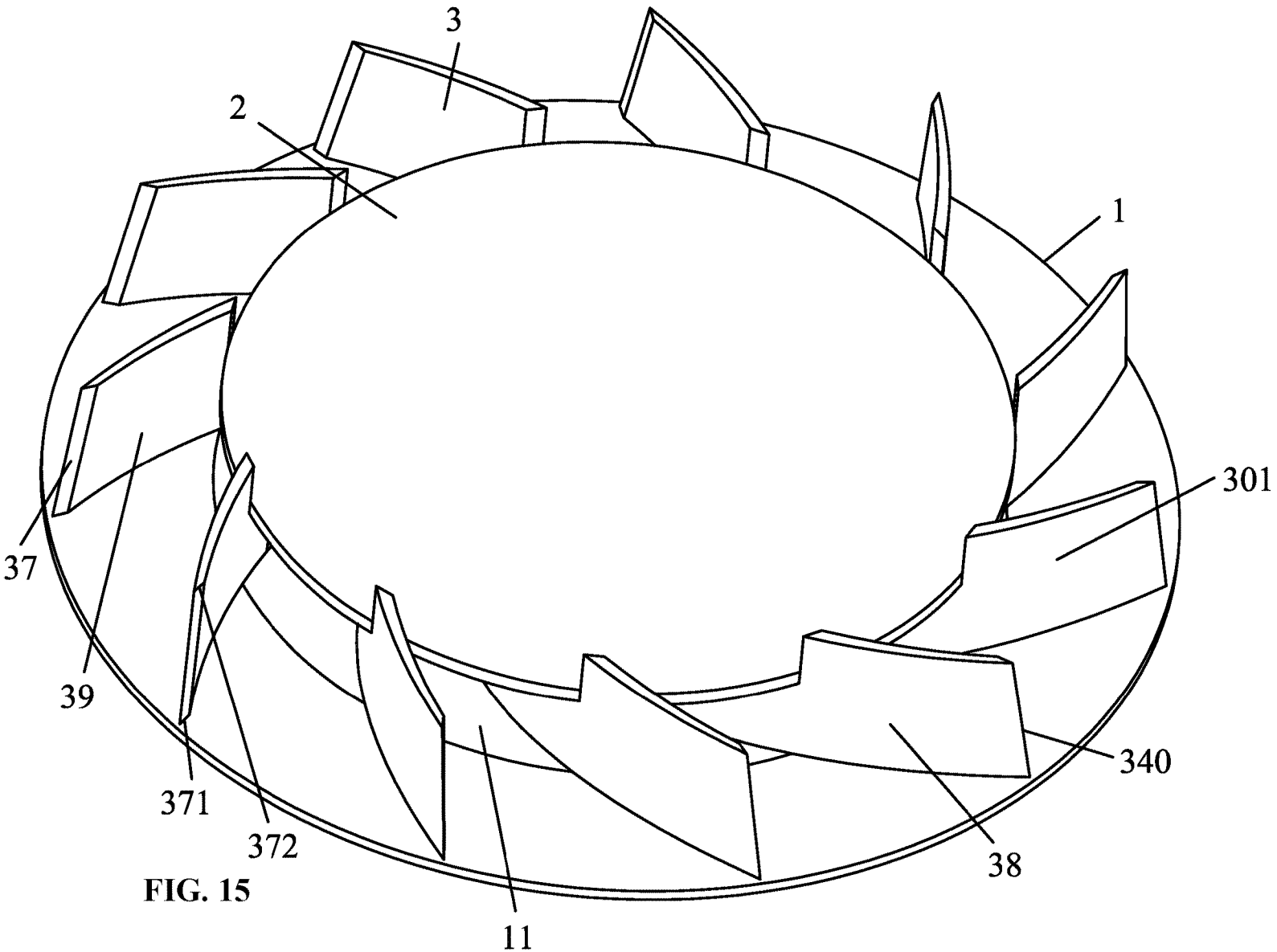
FIG. 15 is a perspective view of a wind wheel in Example 3 of the disclosure.
Figure 16:
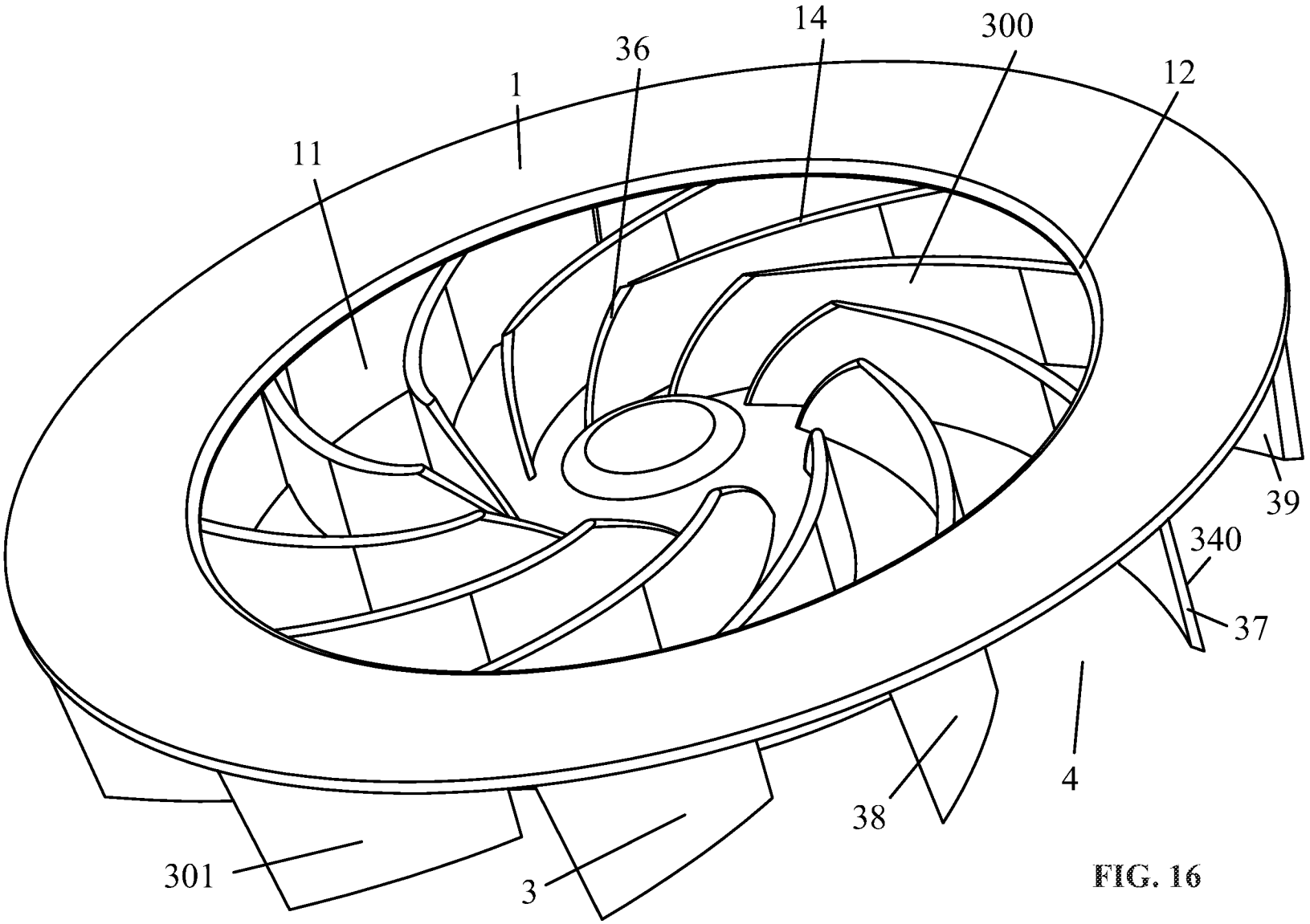
FIG. 16 is a perspective view of a wind wheel in Example 3 of the disclosure at another angle.
Figure 17:
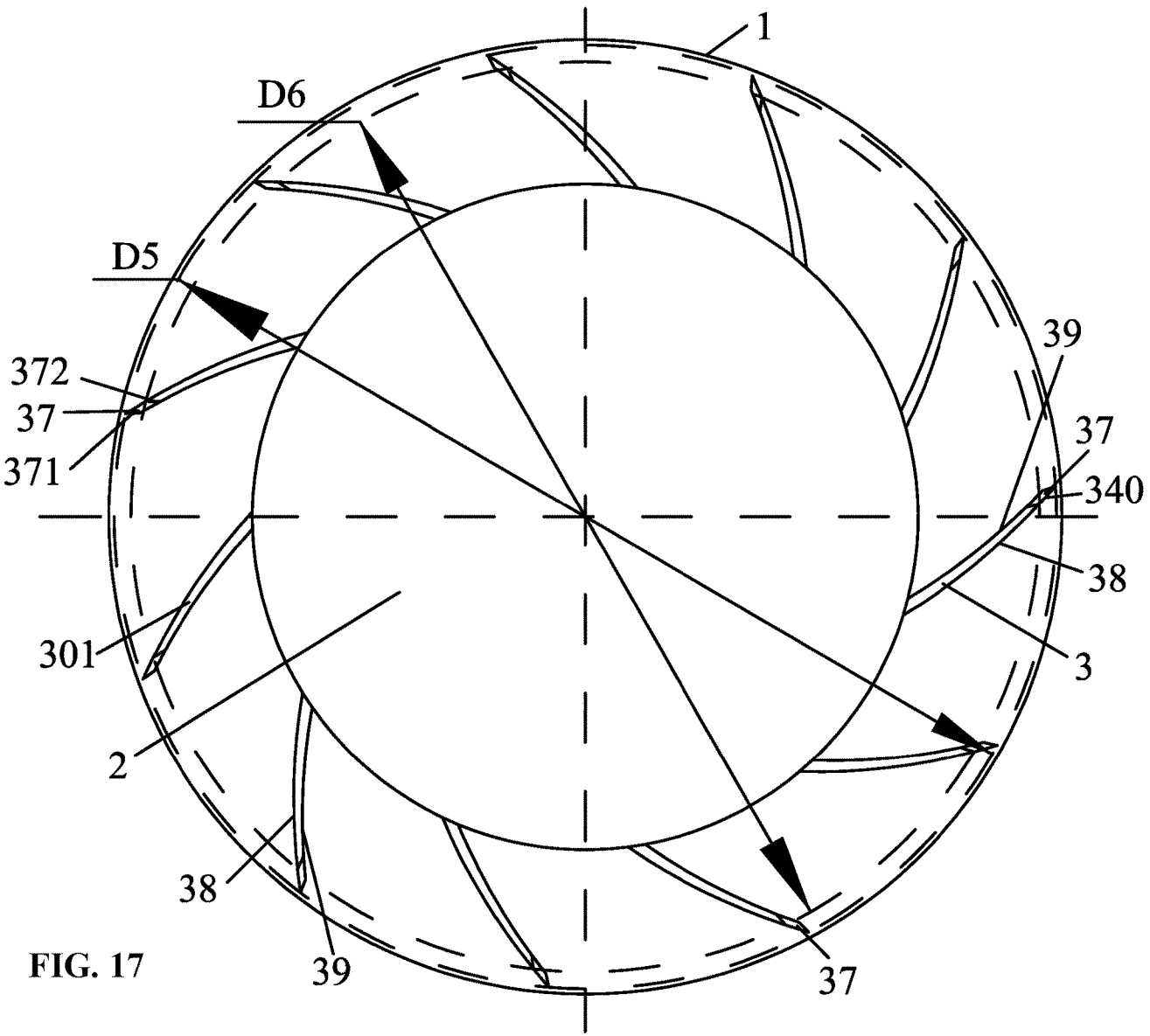
FIG. 17 is a bottom view of a wind wheel in Example 3 of the disclosure.
Figure 18:
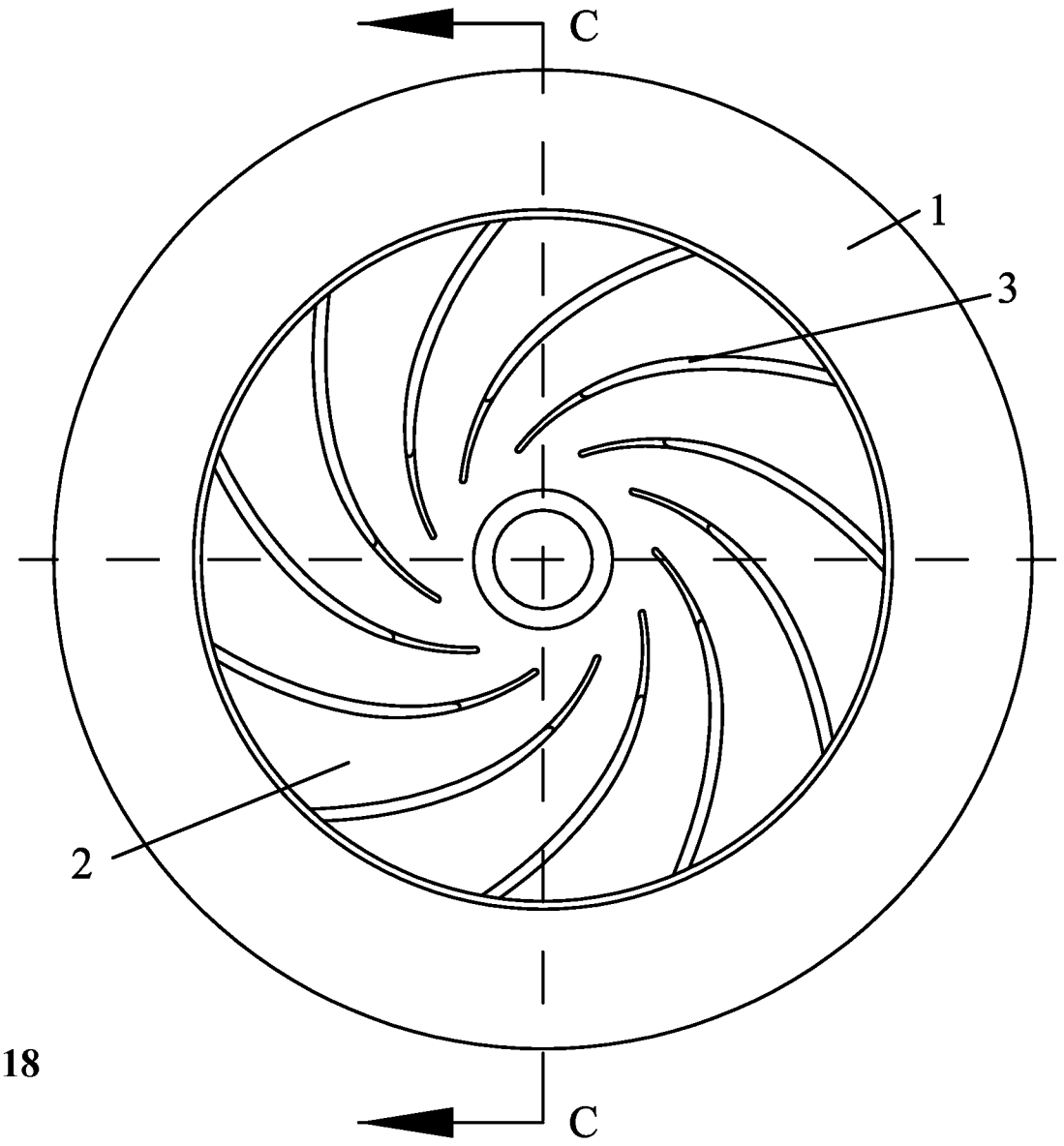
FIG. 18 is a top view of a wind wheel in Example 3 of the disclosure.
Figure 19:
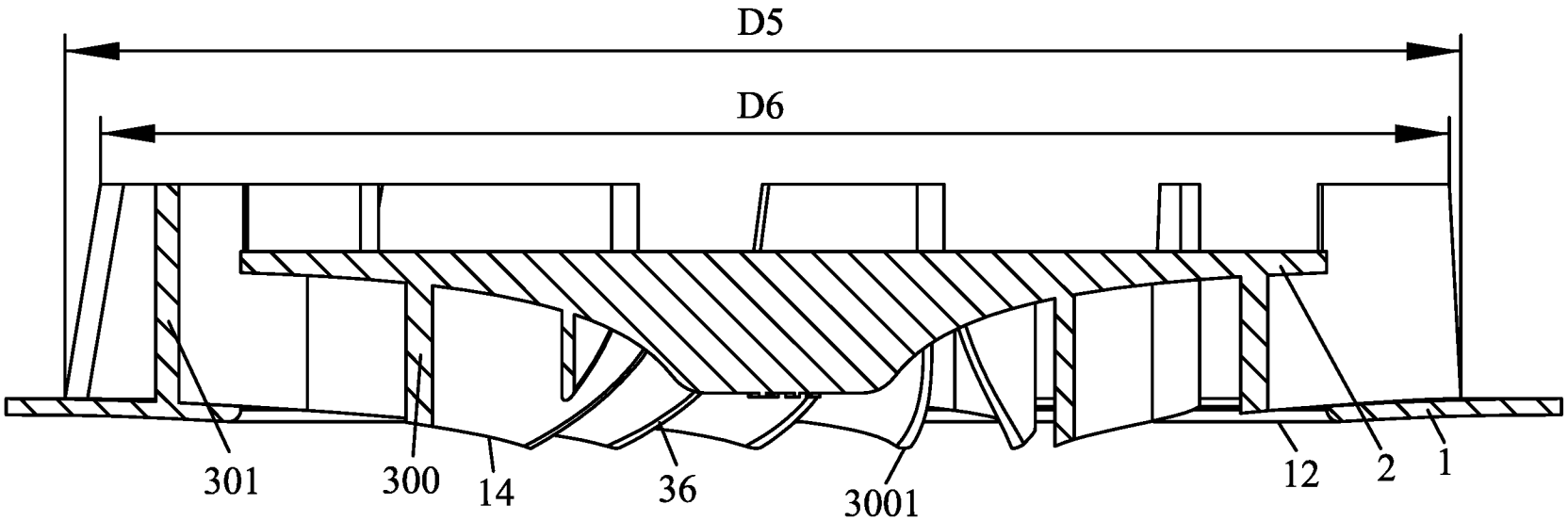
FIG. 19 is a cross-sectional view taken along line C-C of FIG. 18.

As shown in FIG. 15 to FIG. 19, the example an improvement on the basis of Example 1. Each of the blades 3 comprises an inner flank 36 and an outer flank 37. The outer diameter D5 of a circle formed by the lower end 371 of the outer flank 37 is the largest; the outer diameter D6 of a circle formed by the upper end 372 of the outer flank is the smallest; the outer diameter of the circle formed by the outer flank decreases from the lower end to the upper end, and the outer flank 37 is an inclined plane which is inclined from the outside to the inside.

The ratio of the outer diameter D6 of the circle formed by the upper end of the outer flank to the outer diameter D5 of the circle formed by the lower end of the outer flank is between 0.95 and 0.97.

The blade 3 comprises a first side 38 and a second side 39, where the first side 38 is a pressure side, but the second side 39 and the outer flank 37 are negative pressure sides; and an intersection line 340 of the outer flank 37 and the first side 38 is an inclined line, which is inclined from the outside to the inside.

The inner end section 300 protrudes axially to form a tip 301 that is axially higher than the first air plate 1.

Extending from the tip 301 to the second air plate 2 forms an inner flank 36 which is an inclined plane, extending from the tip 301 to the inner edge of the first air plate 1 forms a bottom surface 14 which is an inclined plane, and the slope of the inner flank 36 is larger than that of the bottom surface 14.

EXAMPLE 4

Figure 20:
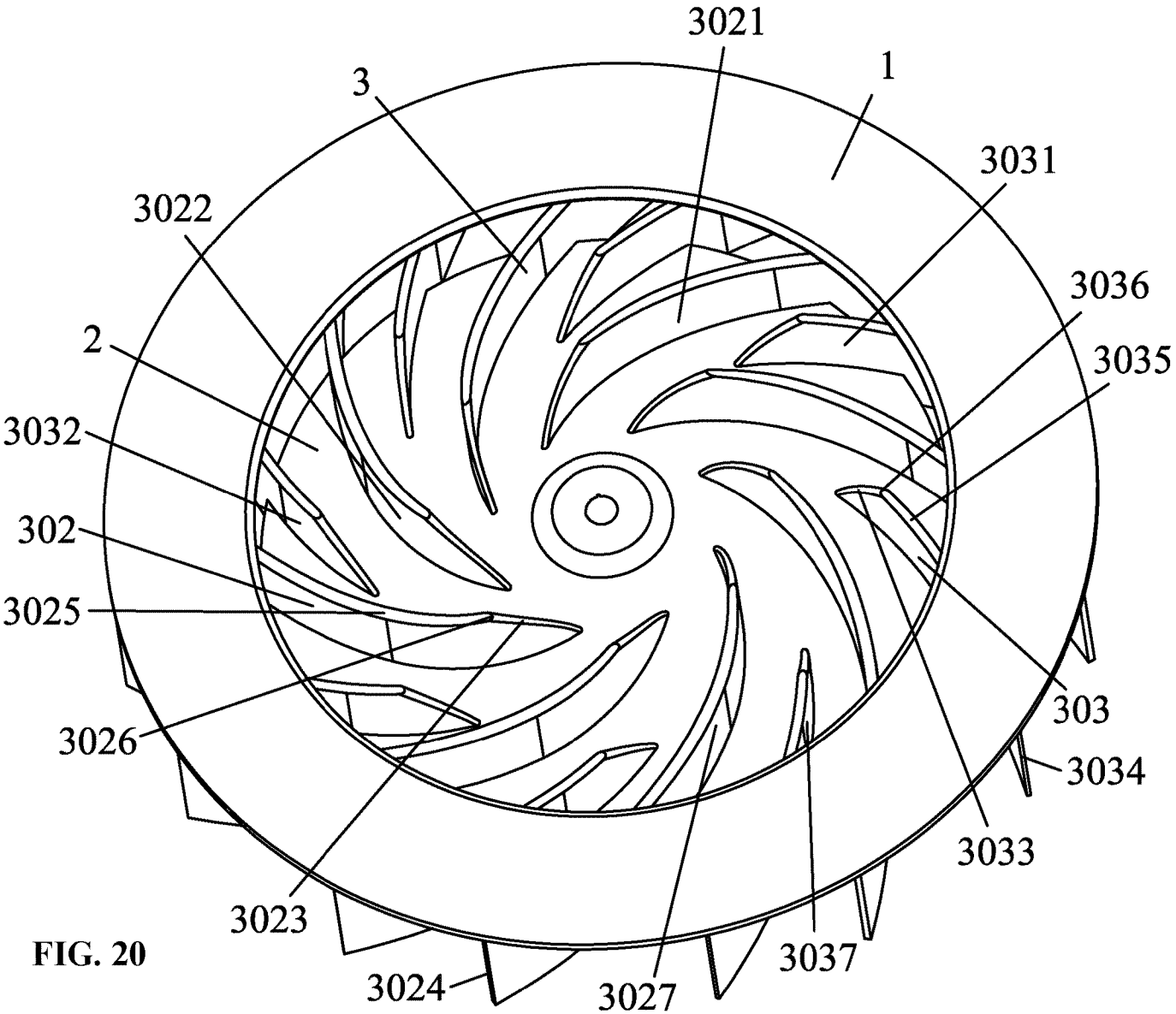
FIG. 20 is a perspective view of a wind wheel in Example 4 of the disclosure.
Figure 21:
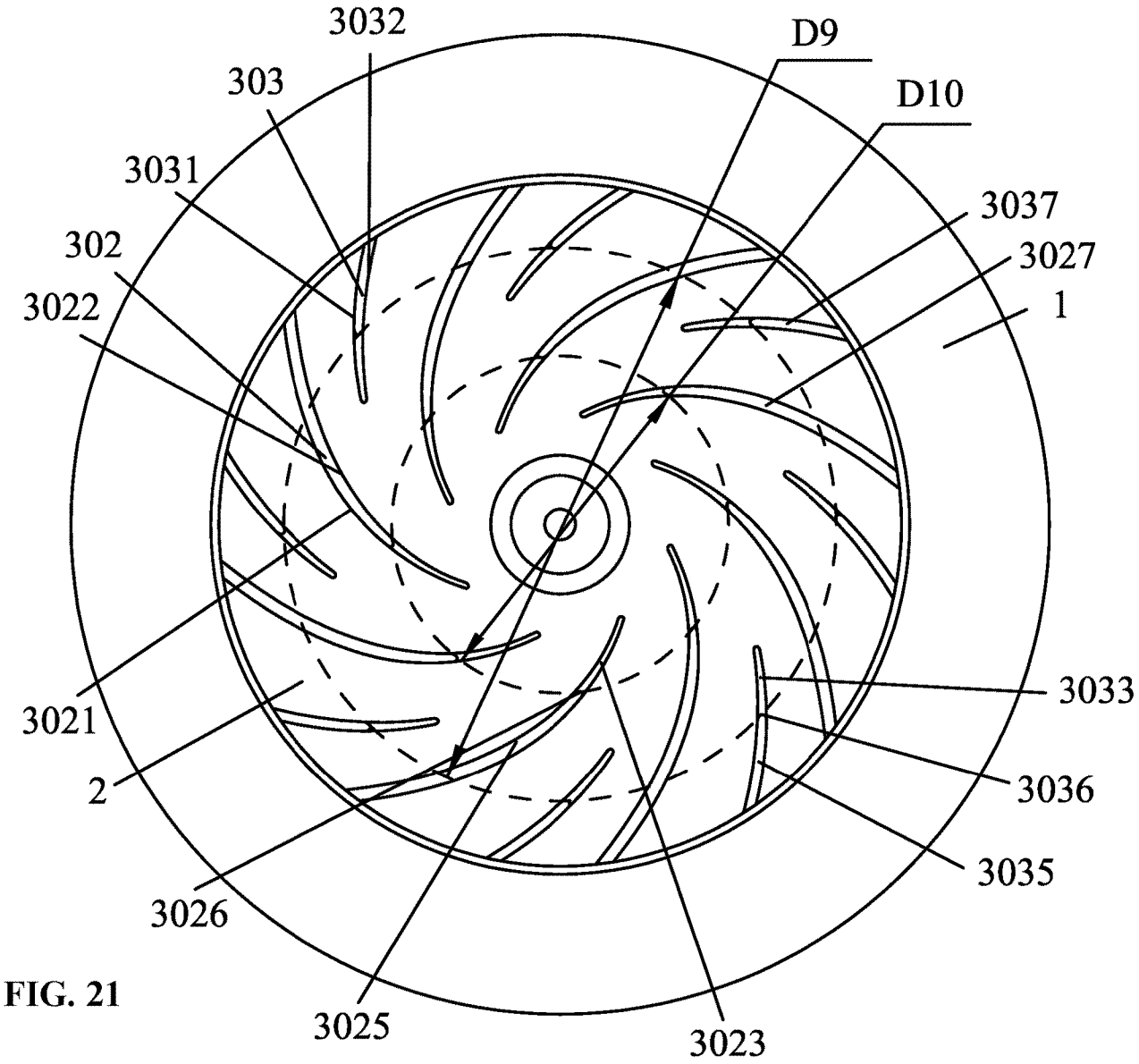
FIG. 21 is a perspective view of a wind wheel in Example 4 of the disclosure at another angle.
Figure 22:
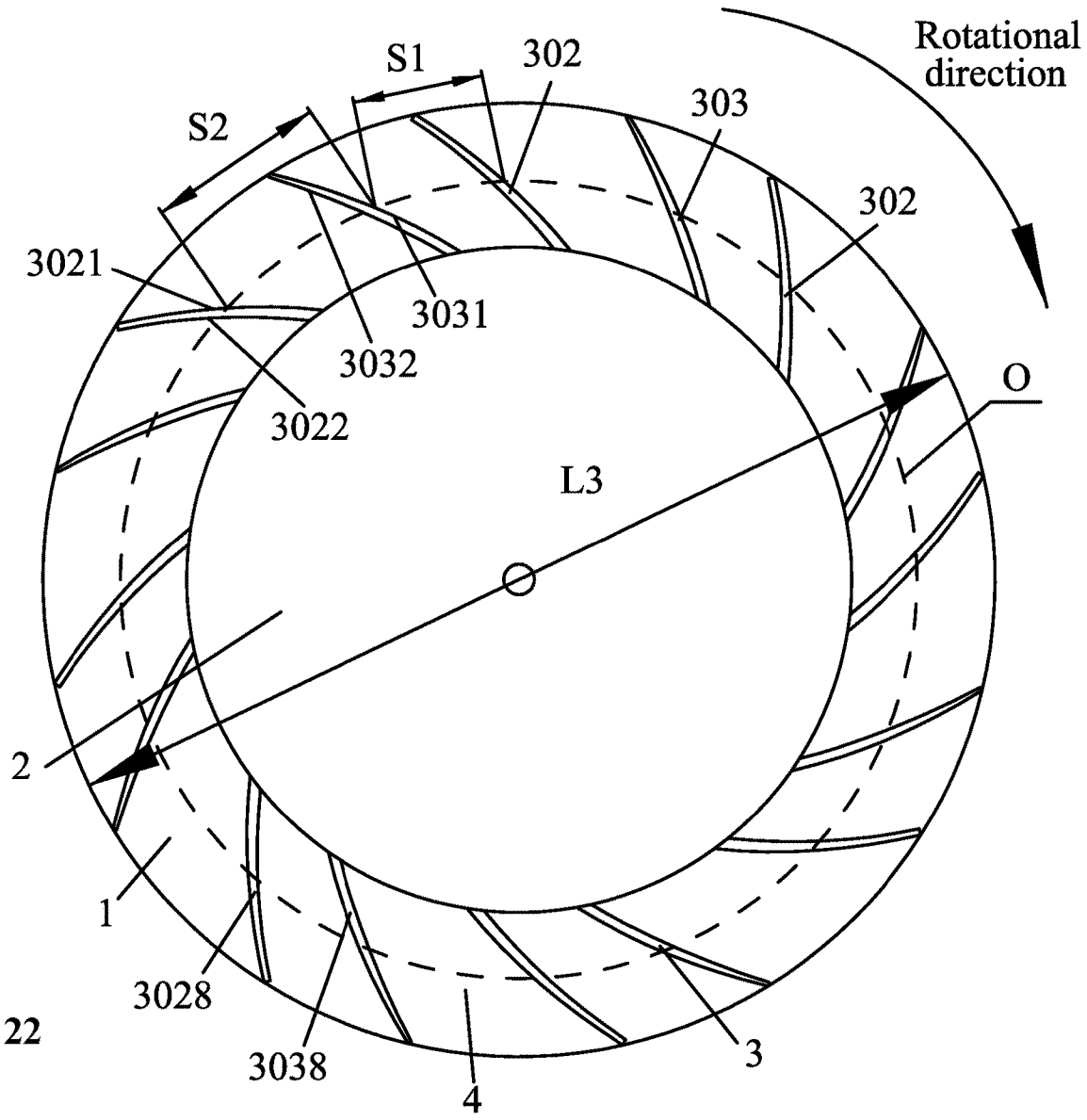
FIG. 22 is a bottom view of a wind wheel in Example 4 of the disclosure.
Figure 23:
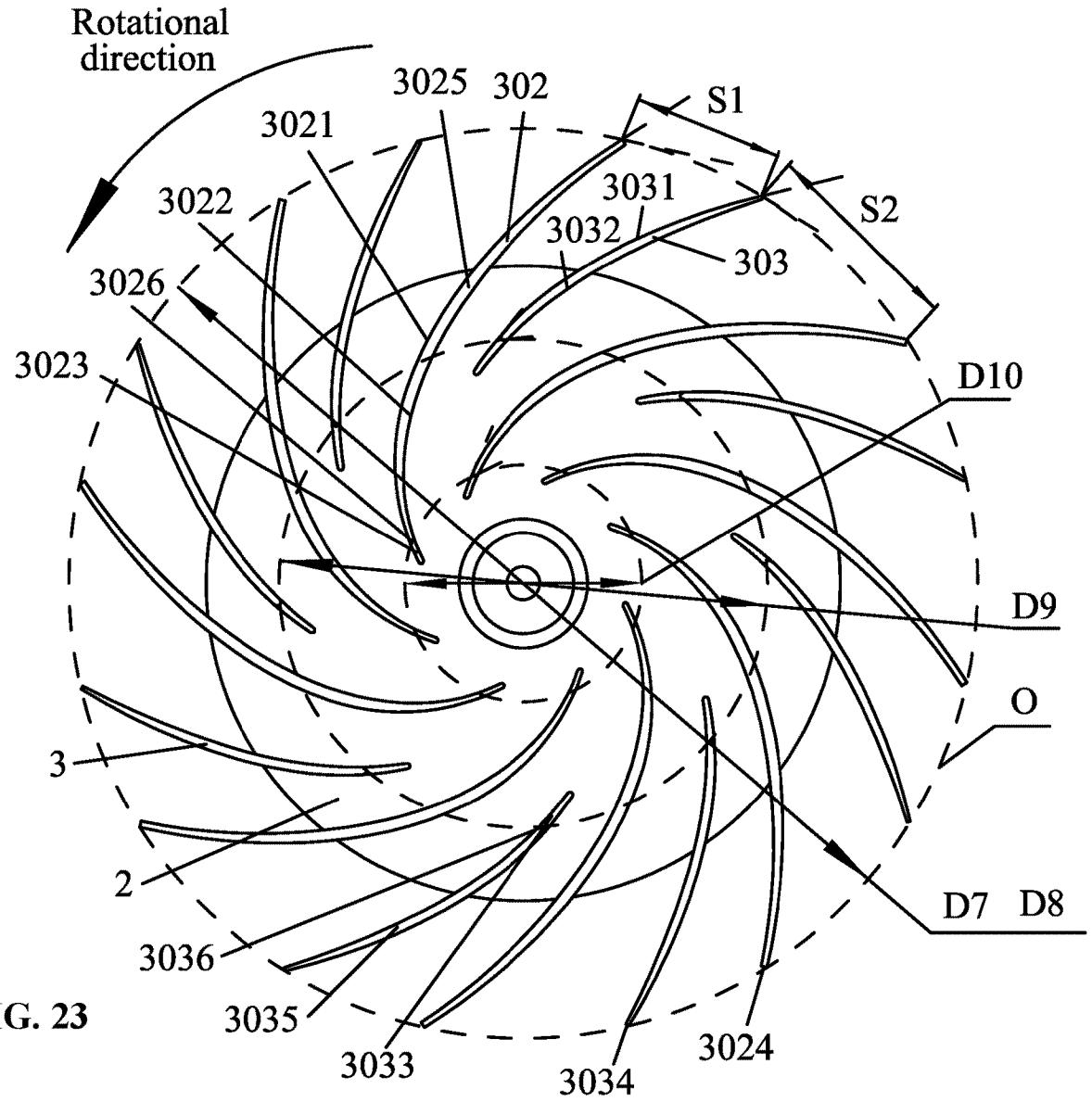
FIG. 23 is a top view of a wind wheel in Example 4 of the disclosure (without the first air plate).

As shown in FIG. 20 to FIG. 23, the blades 3 include a long blade 302 and a short blade 303. The long blade 302 and the short blade 303 are alternately provided circumferentially, the long blade 302 comprises a first pressure side 3021 and a first negative pressure side 3022, the short blade 303 comprises a second pressure side 3031 and a second negative pressure side 3032. On the same circle, S1 is the distance between the second pressure side 3031 and the first pressure side 3021 of the long blade 302; the positions of the two long blades are adjacent and both are the same as the steering of the wind wheel. S2 is the distance between the second pressure side 3031 and the first pressure side 3021 of the long blade 302; the positions of the two long blades are adjacent and both are the same as the steering of the wind wheel, and S1 is smaller than S2.

The long blade 302 comprises the first inner flank 3023 and the first outer flank 3024, and the short blade 303 comprises the second inner flank 3033 and the second outer flank 3034. The diameter D7 of the largest circle formed by the first outer flank 3024 is equal to the diameter D8 of the largest circle formed by the second outer flank 3034.

The long blade 302 comprises a first top surface 3025, and the short blade 303 comprises a second top surface 3035. D9>D10 and D9=2D10. D9 is the diameter of a circle formed by the intersection line 3036 of the second inner flank 3033 and the second top surface 3035, and D10 is the diameter of a circle formed by the intersection line 3026 of the first inner flank 3023 and the first top surface 3025.

The second inner flank 3033 and the second top surface 3035 are inclined surfaces. The slope of the second inner flank 3033 is larger than that of the second top surface 3035. The intersection line 3026 of the first inner flank 3023 and the first top surface 3025 is axially higher than the first air plate 1, and the intersection line 3036 of the second inner flank 3033 and the second top surface 3035 is axially higher than the first air plate 1.

The diameter D7 and the diameter D8 are smaller than or equal to the outer diameter L3 of the first air plate 1.

The long blade 302 is divided into a first inner end portion 3027 connected to the second air plate 2 and a first outer end portion 3038 extending radially from the second air plate 2. The first outer end portion 3028 is axially protruded to form a first protrusion that is higher than the second air plate 2. The short blade 303 is divided into a second inner end portion 3037 connected to the second air plate 2 and a second outer end portion 3038 extending radially from the second air plate 2. The second outer end portion 3038 is axially protruded to from the second protrusion that is higher than the second air plate 2.

EXAMPLE 5

A blower comprises a volute, a cover plate, a motor, a motor shaft, and a wind wheel; the cavity is formed by the volute and the cover plate being mounted and connected together; the wind wheel is installed in the cavity, the air outlet is disposed on the volute, and the air inlet is disposed on the cover plate, the wind wheel can be the any one of examples 1, 2, 3, and 4.

It will be obvious to those skilled in the art that changes and modifications may be made, and therefore, the aim in the appended claims is to cover all such changes and modifications.

What is claimed is:

1. A wind wheel, comprising: a first air plate, a second air plate, and a plurality of blades disposed between the first air plate and the second air plate;

wherein:

the first air plate comprises a central part and an air inlet disposed in the central part;

each two adjacent blades form an air duct;

the plurality of blades each comprises an inlet section that is adjacent to the air inlet, an outlet section that is distant from the air inlet, and an intermediate section disposed between the inlet section and the outlet section;

a thickness of the intermediate section is greater than a thickness of the inlet section and a thickness of the outlet section;

the outlet section comprises a boss that extends axially away from the first air plate and the second air plate;

the inlet section comprises a first connecting end connected to the intermediate section and an innermost end that is adjacent to the air inlet;

the outlet section comprises a second connecting end connected to the intermediate section and an outermost end connected to the second connecting end;

the thickness of the innermost end is H1, the thickness of the outermost end is H3, and H1=H3;

an outer diameter D3 of the plurality of blades is less than an outer diameter D4 of the first air plate; and a portion of the inlet section extends axially away from the first air plate and the second air plate.

2. The wind wheel of claim 1, wherein the intermediate section comprises a middle part and two ends; and the thickness of the intermediate section decreases from the middle part to the two ends.

3. The wind wheel of claim 2, wherein the thickness of the inlet section decreases from the first connecting end to the innermost end.

4. The wind wheel of claim 3, wherein the thickness of the outlet section decreases from the second connecting end to the outermost end.

5. The wind wheel of claim 4, wherein a profile of each of the plurality of blades is an arc; the arc comprises an inlet angle at a point, wherein the inlet angle at the point is an included angle formed by a first line LI and a second line L2 the first line LI is tangent to a circle that crosses the point and that is concentric to the air inlet, and the second line L2 is tangent to the arc at the point; and the inlet angle on the arc increases from the innermost end to the outermost end.

6. The wind wheel of claim 5, wherein the innermost end has the inlet angle of θ1, the outermost end has the inlet angle of θ2, and θ2=1.5 θ1; the thickness of the middle part is H2, and H1=H3=0.5 H2.

7. The wind wheel of claim 5, wherein the inlet section extends in the air inlet; and the outlet section of each of the plurality of blades protrudes radially out of an edge of the second air plate.

8. The wind wheel of claim 7, wherein the first air plate, the second air plate, the plurality of blades and the boss form an integrated structure through injection molding.

9. The wind wheel of claim 3, wherein the inlet section comprises an inlet end; a flank of the inlet end is tilted; and the flank of the inlet end is not perpendicular to the first air plate.

10. The wind wheel of claim 9, wherein a distance from a top end of the plurality of blades to a bottom surface of the second air plate is inconstant and decreases from a center to an edge of the second air plate.

11. The wind wheel of claim 10, wherein a height of the second air plate decreases from the center to the edge of the second air plate; and a height of the air duct increases from the center to the edge of the second air plate.

12. The wind wheel of claim 11, wherein a cross section of the first air plate is an arc structure.

13. The wind wheel of claim 3, wherein each of the plurality of blades comprises an inner flank and an outer flank relative to the air inlet; the outer flank is inclined inwards relative to the air inlet; the outer flank comprises an upper end and a lower end relative to the first air plate; an outer diameter D5 of a circle formed by the lower end of the outer flank is larger than an outer diameter D6 of a circle formed by the upper end of the outer flank; and an outer diameter of a circle formed by the outer flank decreases from the lower end to the upper end.

14. The wind wheel of claim 13, wherein a ratio of the outer diameter D6 of the circle formed by the upper end of the outer flank to the outer diameter D5 of the circle formed by the lower end of the outer flank is between 0.95 and 0.97.

15. The wind wheel of claim 14, wherein the plurality of blades each comprises a first side and a second side; the first side is a pressure side, and the second side and the outer flank are negative pressure sides; and an intersection line of the outer flank and the first side is an inclined line, which is inclined inwards relative to the air inlet.

16. The wind wheel of claim 15, wherein the plurality of blades each comprises an inner end section which comprises a tip axially extending out of the first air plate.

17. The wind wheel of claim 16, wherein the inner flank is an inclined plane extending from the tip to the second air plate; the tip extends to an inner edge of the first air plate to form a bottom surface which is an inclined plane; and a slope of the inner flank is larger than that of the bottom surface.

* * * * *